United States Patent [19]

Matsuguchi

[11] Patent Number: 4,585,506

[45] Date of Patent: Apr. 29, 1986

[54] PRESSURE SENSITIVE ADHESIVE LABEL AFFIXING DEVICE

[75] Inventor: Yutaka Matsuguchi, Osaka, Japan

[73] Assignee: Osaka Sealing Printing Co., Ltd., Osaka, Japan

[21] Appl. No.: 558,439

[22] Filed: Dec. 6, 1983

[30] Foreign Application Priority Data

Dec. 3, 1982 [JP] Japan ..... 57-213215

[51] Int. Cl.[4] ..... B65H 26/00

[52] U.S. Cl. ..... 156/361; 156/363; 156/542

[58] Field of Search ..... 156/361-363, 156/351, 584, 542

[56] References Cited

U.S. PATENT DOCUMENTS

| | | | |
|---|---|---|---|
| Re. 30,419 | 10/1980 | Crankshaw et al. | 156/584 X |
| 4,106,972 | 8/1978 | Caudill | 156/363 |
| 4,183,779 | 1/1980 | Barber et al. | 156/361 |
| 4,264,396 | 4/1981 | Stewart | 156/542 X |
| 4,276,112 | 6/1981 | French et al. | 156/542 X |
| 4,294,644 | 10/1981 | Anderson | 156/361 |
| 4,397,709 | 8/1983 | Schwenger | 156/351 |
| 4,434,911 | 3/1984 | Sakura | 156/542 X |

*Primary Examiner*—David Simmons

*Attorney, Agent, or Firm*—Birch, Stewart, Kolasch & Birch

[57] ABSTRACT

The present invention relates to a pressure sensitive adhesive label affixing device.

This device is designed to release adhesive labels from a continuous line of labels prepared by temporarily sticking them to the surface of a web of supporting or backing material one after another, and to affix each thereof to an article to be labelled. The device includes an input unit, a label detector, an article detector and a control means.

The input unit is used in inputting set values required for setting a label pitch.

The label detector detects the presence of each label temporarily stuck to the backing material and sends a label detection signal to the control means.

The article detector detects each article and sends an article detection signal to the control means.

On the basis of the set value, label detection signal and article detection signal received, the control means controls the label affixing device so that the label is affixed precisely in place on the article.

According to the present invention, it is also possible to do numerical processing for controlling the labelling position for sizable savings of the time required for operation of the label affixing device.

13 Claims, 10 Drawing Figures

PRESSURE SENSITIVE ADHESIVE LABEL AFFIXING DEVICE

BACKGROUND OF THE INVENTION

Heretofore, an adhesive label affixing device was provided with a detector for detecting the rear end of a label when the forward end thereof comes into contact with the article to be labelled in accordance with the size of the label temporarily stuck to a web of backing material.

And the device used to be for affixing the adhesive label in place on the surface of the article according to the detection signal transmitted by the above-mentioned detector.

With such a device, however, it was necessary to adjust the position of the detector each time the size of the adhesive label temporarily stuck to the backing material was changed. (See FIGS. 7(*a*) and 7(*b*). And the work of adjusting the position of the detector was time-consuming, being by no means easy. Moreover, with such a device, it was necessary to convey the articles to be labelled at the predetermined intervals according to the pitch at which the labels etc. were fed.

That is, failure of the agreement of the pitch of the labels etc. with the interval between the articles resulted in a difficulty of affixing the label precisely in place on the article. This was particularly the case and the consequence could be serious when, for instance, a label having printed thereon a "mark for reading" such as "bar code symbol" was to be affixed precisely in place on an article. This is because the "mark for reading" such as "bar code symbol" cannot be read or can only be read, with great difficulty, by the reading device unless the label bearing it is affixed at the predetermined position on the article.

SUMMARY OF THE INVENTION

The present invention has been worked out in view of the above-described problems.

The invention relates to a pressure sensitive adhesive label affixing device comprising an input unit, a label detector, an article detector and a control means and capable of affixing each label precisely in place on the article to be labelled.

It is, therefore, a principal object of the present invention to provide an adhesive label affixing device capable of freely positioning each adhesive label on each of the articles to be labelled being conveyed (i.e. arriving) at irregular intervals for subsequent affixing thereof precisely in place on the article.

The adhesive label affixing device of the present invention is adapted to successively feed a continuous line of labels prepared by temporarily and releasably sticking labels to the surface of a web of backing material coated with a strip agent, releasing each label by bending the backing material abruptly off the labels by the aid of a releasing means and position and subsequently affix it in place on the article to be labelled. The label affixing device comprises:

an input unit for freely inputting set values and transmitting setting signals corresponding thereto;

a label detector for detecting each adhesive label and transmitting the corresponding label detection signal;

an article detector for detecting each article arriving on a conveyor and transmitting the corresponding article detection signal; and a control means wired to receive the above-mentioned setting signal, label detection signal and article detection signal for controlling a label feeding means accordingly so that each label is affixed precisely in place on the article to be labelled, i.e. at the position corresponding to the input set values, these connected electrically with one another.

According to the present invention, therefore, it is possible to obtain an adhesive label affixing device capable of freely positioning each label in place on each of the articles arriving at irregular intervals for subsequent affixing thereto.

DETAILED DESCRIPTION OF THE PREFERRED EMBODIMENT

Figure 1:
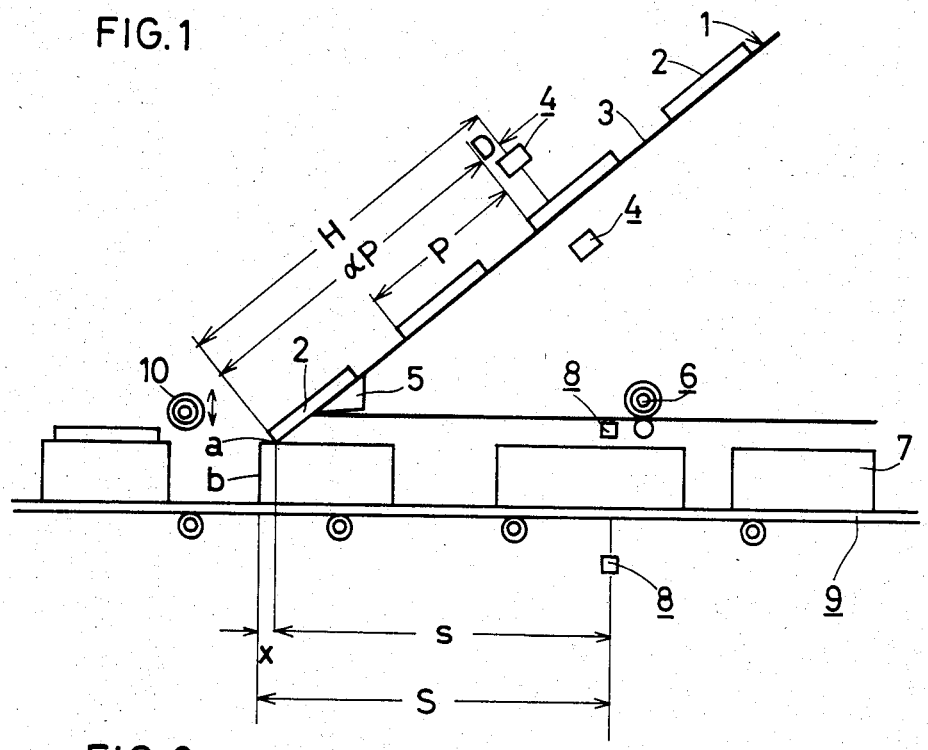
FIG. 1 is a partial side view of an embodiment of the invention.

In the accompanying drawings showing the preferred embodiment, the numeral 1 designates a continuous line of labels. The continuous line of labels 1 comprises a web of supporting or backing material 3 such as paper coated on the surface with a releasing agent such as silicone and labels 2 temporarily stuck thereto.

The numeral 4 designates a label detector, which comprises a light source such as light-emitting diodes, photoelectric tubes etc. and a photosensor such as a Cds element, photodiode, or a phototransistor.

With the label affixing device in operation, the label detector 4 can be fixedly located a predetermined distance off the position (a) where the label 2 comes into contact with the article 7 to be labelled. In practice, a photoelectric switch such as photocoupler may be used as the label detector.

The numeral 5 designates a releasing means, which is made of a hard material such as a metal or synthetic resin with its tip finished to an acute-angled. The releasing means 5 is adapted to bend backing material 3 of the continuous line of labels 1 over its tip to abruptly strip off the labels in substantially the opposite direction to the continued movement of the backing material 3.

The numeral 6 designates a label feeding means, which comprises a motor, conveyor, roller (not shown) etc. The motor etc. are controlled by the label feeding signal from a control means 20 electrically connected therewith and serve to feed the continuous line of labels 1.

The numeral 7 designates an article to be labelled, and the numeral 8 an article detector. The article detector 8 comprises a light source such as light-emitting diodes, photoelectric tubes etc. and a photosensor such as a CdS element, a photodiode, or a phototransistor, and it is fixedly arranged on both sides of the conveyor and the articles on it.

The article detectors 8 can as well be fixedly located a predetermined distance off the position (a) where, with the affixing device in operation, the label 2 comes into contact with the article 7.

The numeral 9 designates a conveyor for carrying the articles, comprising a motor, conveyor belt, rollers (not shown) etc.

The motor etc. are controlled by the article conveying signal from the control means 20 electrically connected therewith for driving the conveyor on which the articles 7 are carried.

The numeral 10 designates a pressure means comprising rubber rollers etc. The rubber rollers etc. are for pressing the label 2 affixed to the article 7 to thereby ensure securer affixing thereof.

The numeral 11 designates an input unit, comprising a display 12, tens-key 13, selection key 14, plus-minus key 15, etc. The input unit 11 is electrically connected with the control means 20, and the display 12 is composed of electronic elements such as an electroluminescent cell.

The display 12 is for displaying electrically set values input through key operation (keys 13, 14, 15 etc.) of the input unit 11, conditions detected by the individual detectors 4, 8 and so on. The keys 13, 14 and 15 of the input unit 11 are for inputting numerical set values etc.: the tens-key 13 is for numerically inputting set values, the plus-minus key 14 is for selecting the plus-minus signs for individual set values, and the selection key 15 is for selecting the kinds of individual set values.

The control means 20 comprises a memory unit, an arithmetic unit (operator) and an input-output interface. The control means 20 is electrically connected with the individual detectors 4, 8, label feeding means 6, conveyor 9, pressure means 10 and input unit 11.

In the figures characters (H), (P), (αP), (D), (s), (x), (S), (L) and (l) designate the respective distances with the label affixing device in operation. (H) is the distance from the label detector 4 to the position (a) where the released label 2 comes into contact with the article 7, and it is the rectilinear distance measured along, i.e. parallel to, the continuous line of labels 1.

(P) is the label pitch of the continuous line of labels 1, this corresponding to the distance between the leading edges of two adjacent labels 2.

(αP) and (D) are the distances determined by the control means 20 by the formulae $$D \leqq P,\ \alpha P = H - D$$

wherein α is an integer.

(s) is the distance from the article detector 8 to the position (a), this being a rectilinear distance measured along, i.e. parallel to, the longitudinal axis of the conveyor.

(x) is the distance between the position (a) and a position (b), which is the leading edge of the article 7 at the moment the released label 2 comes into contact with the article 7, this, too, being a distance measured along the longitudinal axis of the conveyor.

(S) is the total of the distance (s) and the distance (x).

(L) is the dimension of the article 7 in the direction in which it is conveyed.

(l) is the dimension of the label 2 in the direction in which the article 7 is conveyed.

Now described is the way the label affixing device of the present invention operates.

First the operator is to input numerically the distances (H), (P), (s) and (x) through the input unit 11 with its keys 13, 14, 15, and the respective values so input are displayed on the display 12. Correction of the input values is feasible by means of the same keys 13, 14, 15.

The control means 20 then calculates the values (D), (αP) and (S) from the input values (H), (P), (S) and (X) by the formulae $$D \leqq P,\ \alpha P = H - D \text{ (where } \alpha \text{ is an integer)}$$

and $$S = s + x.$$

Also, the control means 20 stores in its memory the values (H), (P), (s), (x), (D), (αP) and (S).

Figure 2:
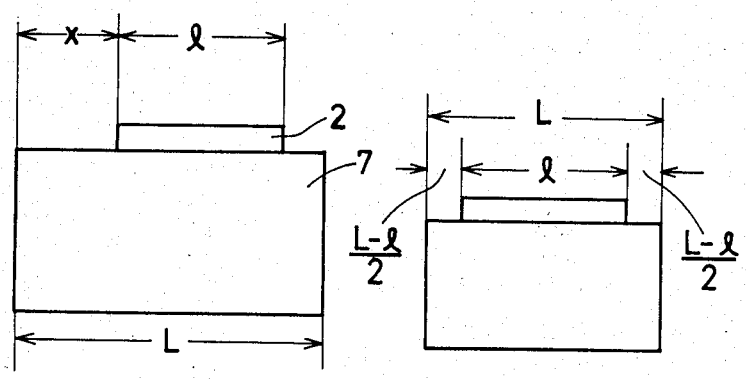
FIG. 2 is a side view showing an adhesive label as affixed to an article.
Figure 3:
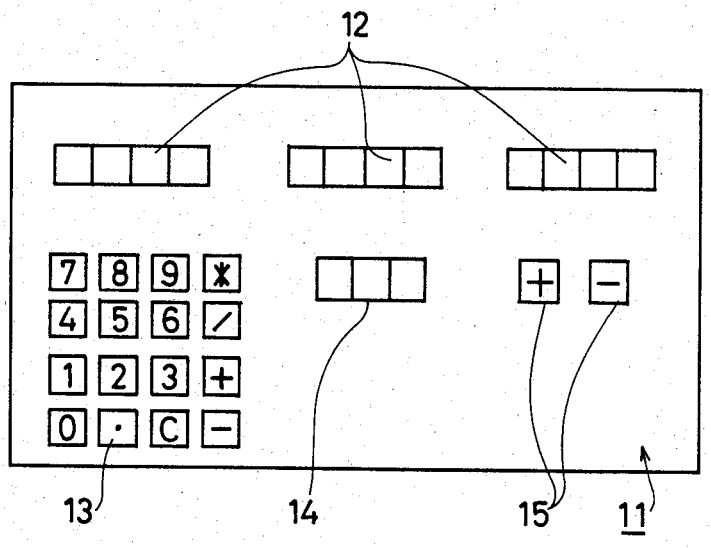
FIG. 3 is a front view of an input unit according to the embodiment of the invention.
Figure 4:
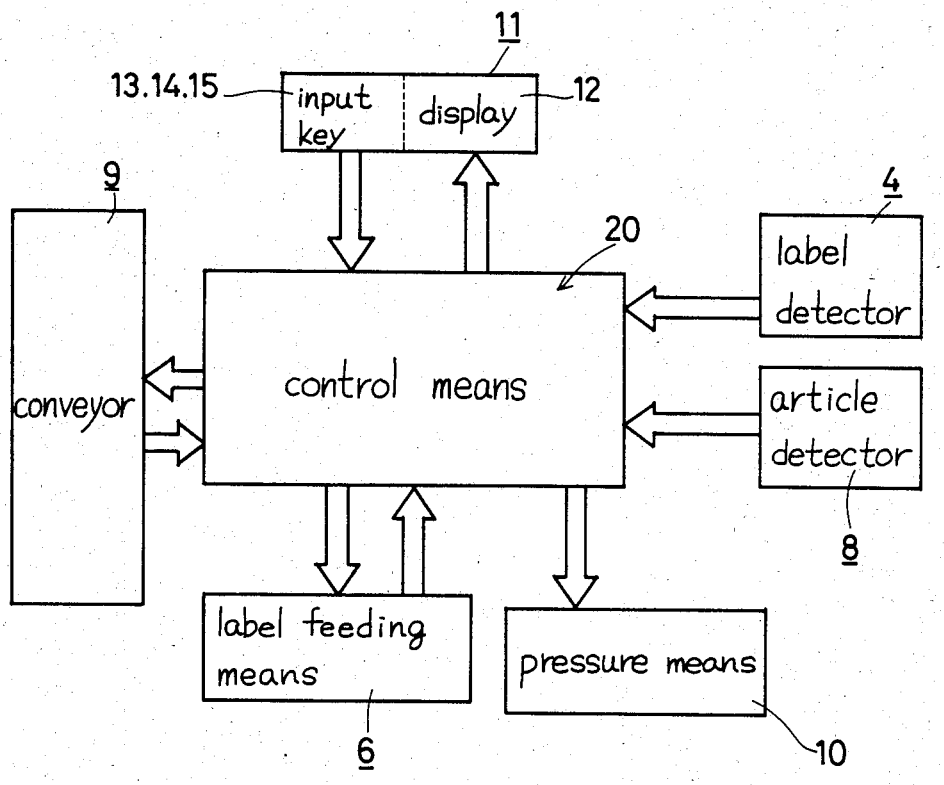
FIG. 4 is a block diagram of the embodiment.

An alternative method of determining the position in the surface of the article at which the label is to be affixed consists in first inputting the distances (H), (P), (l), (s) and (L) (See FIG. 2.) for the values (D), (αP), (x) and (S) to be calculated therefrom by the control means 20 by the formulae $$D \leqq P,\ \alpha P = H - D \text{ (where } \alpha \text{ is an integer)}$$

and $$(L - l)/2$$

and $$S = s + x$$

and having the values (H), (P), (l), (s), (L), (D), (αP), (x) and (S) stored in the memory of the control means 20.

The label 2 is then affixed to the article 7 with the center of the label 2 along its feeding direction registering with the center of the article 7 along its conveying direction. (See FIG. 2.)

Then label feeding means 6 and the conveyor 9 are started, and the former feeds the continuous line of labels 1 until the leading edge of the label 2 being released reaches the article 7. The label feeding means 6 then comes to a temporary stop.

The control means 20 then receives the label detection signal from the label detector 4 and thereby acertains arrival of the continuous line of labels 1 at the position for temporary stopping (i.e. the position past the label detector 4 by the distance (D)). Thereupon the control means 20 transmits the label stopping signal for temporarily stopping the label feeding means 6 for the latter to be stopped temporarily thereby.

Figure 5:
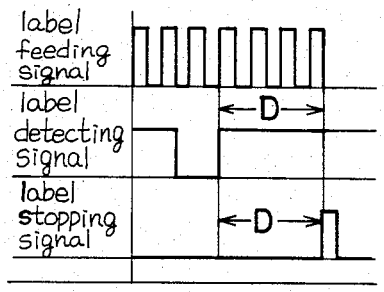
FIG. 5 (note—5(I) and 5(II)) is a timing chart showing the pulses for controlling stopping of a label feeding means.
Figure 5:
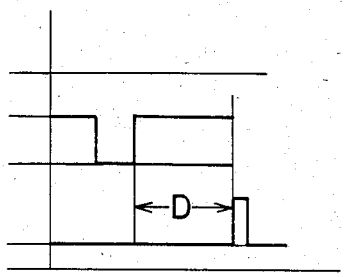

For ascertaining arrival of the continuous line of labels 1 at the position for temporary stopping (i.e. the position past the label detector 4 by the distance (D)) the control means 20 starts counting the number of pulses generated in proportion to the feeding distance of the label feeding means 6 from the moment the leading edge of the foremost label is detected by the label detector 4 until the count of the aforesaid pulses come to be what is equivalent to the distance (D). (See FIG. 5 (I).)

The pulses occurring in proportion to the feeding distance of the label feeding means 6 are what are generated by a pulse generator (not shown) of the label feeding means 6.

The pulse generator is synchronized with the rotation of the motor of the label feeding means 6 so as to generate a number of pulses corresponding to the feeding distance of the label 2.

Alternatively, it is also possible for confirmation of the above to measure the time required for the label 2 to be fed by the distance (D) by the label feeding means 6 from the moment the leading edge of the foremost label 2 is detected by the control means 20. (See FIG. 5(II).)

Meanwhile, the articles 7 are conveyed by the conveyor 9 and detected by the article detector 8.

Also, the detector 8 transmits the article detection signal to the control means 20 each time it detects the article 7.

When it has been ascertained by the control means 20 by receipt of the article detection signal that the leading edge of the article 7 being conveyed has reached the position (b), the control means 20 transmits the label feeding signal to the label feeding means 6 for it to be started thereby.

Thereupon the label feeding means 6 is restarted for the label 2 to be affixed precisely in place on the article.

Figure 6:
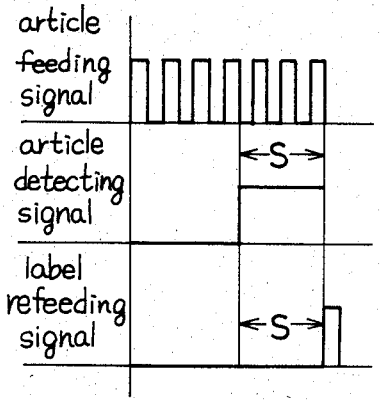
FIG. 6 (note—6(I) and 6(II)) is another timing chart showing the pulses for controlling starting of the label feeding means.
Figure 6:
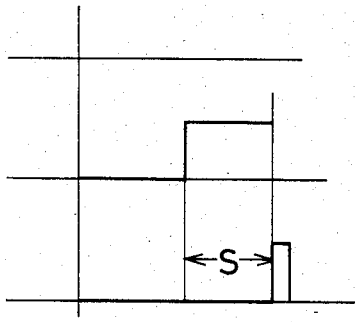
Figure 7A:
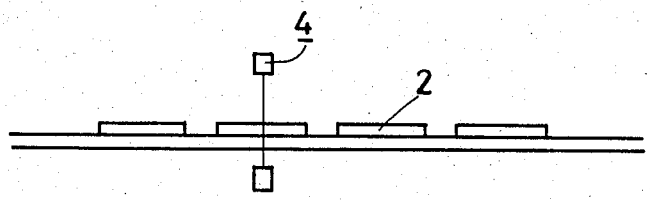
FIGS. 7(*a*) and 7(*b*) are sketches showing the relation between the detector and the label in a prior-art counterpart.
Figure 7B:
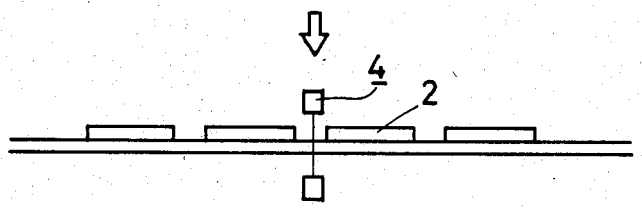

Ascertaining of the forward end of the article 7 being conveyed having reached with position (b) is done by counting the pulses occurring in proportion to the conveying distance of the conveyor 9 from the moment the article 7 is detected by the article detector 8 and confirming the count of pulses taken having reached what is equivalent to the distance (S). (See FIG. 6(I).)

The pulses occurring in proportion to the conveying distance of the conveyor 9 are what are generated by the pulse generator (not shown) such as an encoder of the conveyor 9 as a function of the conveying distance.

The pulse generator is synchronized with the rotation of the motor of the conveyor 9 so as to generate a number of pulses corresponding to the feeding distance of the label 2.

The pulse generator is synchronized with the rotation of the motor of the conveyor 9 so as to generate pulses corresponding to the conveying distance of the article 7.

Alternatively, it is also possible for confirmation of the above to measure the time required for the article 7 to be conveyed by the distance (S) by the conveyor 9 from the moment the leading edge of the (foremost) article 7 is detected by the control means 20. (See FIG. 6(II).)

Later the pressure means 10 is used for pressing the label 2 affixed to the article 7 to ensure securer affixation thereof.

Feeding of the continuous line of labels 1 is temporarily stopped when the leading edge of the label 2 next to the one just affixed has reached the position (a).

And its feeding is restricted by the label feeding signal from the control means 20 when the leading edge of the next article 7 has reached the position (b), and thereafter the above-described procedure is repeated in cycles.

It is so designed that the entire operation of the device is stopped automatically, i.e. by the control means, when all pieces of a continuous line of labels have been used up.

The setup of the label affixing device of the present invention being as described above in detail, affixing of the label 2 precisely in place on each article is feasible even when the articles 7 are conveyed to arrive at irregular intervals, and, moreover, since it is so adapted that the entire operation of the device is stopped automatically when the loaded labels have all been used up, unnecessary conveyance of unlabelled articles 7 can be avoided without fail.

What is claimed is:

1. A pressure sensitive adhesive label affixing device comprising:

a label affixing station for affixing a label to an article;

article carrying means for carrying said article to said label affixing station;

article sensing means disposed in a transferring path of said article at the upstream side of said label affixing station for sensing an edge of said article;

first setting means for setting data related to a distance (S) between said article sensing means and the presence of the edge of the article at said label affixing station;

detecting means for detecting that said article is carried by said distance (S) by said article carrying means in response to an output of said article sensing means;

label supplying means for supplying said label to said label affixing station in response to the detection of said detecting means;

second setting means for setting data related to a distance (s) between said label affixing station and said article sensing means; and third setting means for setting data related to a distance (x) between said edge of said article and the position where said label is to be affixed; wherein said first setting means includes computing means for solving the equation ($S=s+x$) based on said data (s) and (x) to evaluate said data related to said distance (S).

2. A pressure sensitive adhesive label affixing device in accordance with claim 1, wherein said third setting means includes evaluating means for evaluating said data related to said distance (x) based on the length (L) of said article and the length (l) of said label.

3. A pressure sensitive adhesive label affixing device in accordance with claim 2, wherein said evaluating means included in said third setting means computes the equation $[x=(L-l)/2]$.

4. A pressure sensitive adhesive label affixing device in accordance with claim 1, wherein said label supplying means includes a backing material on which a plurality of labels are temporarily and releasably adhered at a predetermined pitch in the longitudinal direction;

feeding means for feeding said backing material to said label affixing station in the longitudinal direction thereof;

label sensing means fixed at the upstream side of said label affixing station on said feeding path of said backing material for sensing an edge of said label and said backing material;

fourth setting means for setting data related to a distance (D) between said label sensing means and an edge of the nearest label thereto when a label is present on said label affixing station;

fed amount detecting means for detecting a fed amount (d) of said backing material in response to an output of said label sensing means;

first commanding means for applying a stop command to said feeding means to stop feeding of said backing material if and when said fed amount (d) becomes eaual to said distance (D) set by said fourth setting means; and second commanding means for applying a start command to said feeding means if and when said article reaches said label affixing station.

5. A pressure sensitive adhesive label affixing device in accordance with claim 4, wherein said label affixing station includes releasing means for releasing off said label reached from said backing material.

6. A pressure sensitive adhesive label affixing device in accordance with claim 5, wherein said releasing means includes a releasing plate, and said label is stripped from said backing material when said backing material is suddenly bent around an edge of said releasing plate.

7. A pressure sensitive adhesive label affixing device in accordance with claim 6, wherein an article carrying rate by said article carrying means is set equal to or larger than a label feeding rate by said feeding means.

8. A pressure sensitive adhesive label affixing device in accordance with claim 4, wherein said first, second, third and fourth setting means includes, respectively input means capable of inputting numerical data, and storing means for storing said numerical data inputted by said input means.

9. A pressure sensitive adhesive label affixing device in accordance with claim 8, which further comprises fifth setting means for setting data related to a distance (H) between said label sensing means and said label present at said label affixing station; and sixth setting means for setting data related to a pitch (P) of said plurality of labels on said backing material, wherein said fourth setting means includes computing means for solving an equation ($D-H-\alpha P:P \geqq D$, where $\alpha$ is an integer) based on said data (H) and (P) from said fifth and sixth setting means to evaluate said data related to said distance (D).

10. A pressure sensitive adhesive label affixing device in accordance with claim 9, wherein said fifth and sixth setting means includes, respectively input means capable of inputting numerical data, and storing means for storing said numerical data inputted by said input means.

11. A pressure sensitive adhesive label affixing device in accordance with claim 2, wherein (S) is the distance between said article sensing means and the leading edge of the article present at said label affixing station and the distance (x) is measured from the leading edge of the article.

12. A pressure sensitive adhesive label affixing device in accordance with claim 3, wherein (S) is the distance between said article sensing means and the leading edge of the article present at said label affixing station and the distance (x) is measured from the leading edge of the article.

13. A pressure sensitive label affixing device in accordance with claim 9, wherein (D) is the distance between said label sensing means on the leading edge of the nearest label thereto, (H) is the distance between said label sensing means and a leading edge of the label present at said label applying station and the pitch (S) is the distance between the leading edges of adjacent ones of said plurality of labels on said backing material.

* * * * *